US007613405B2

(12) United States Patent
Endo

(10) Patent No.: US 7,613,405 B2
(45) Date of Patent: Nov. 3, 2009

(54) IMAGE FORMING APPARATUS COMPRISING A PLURALITY OF IMAGE CARRIERS

(75) Inventor: Yoshinori Endo, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 453 days.

(21) Appl. No.: 11/492,986

(22) Filed: Jul. 26, 2006

(65) Prior Publication Data

US 2007/0036560 A1 Feb. 15, 2007

(30) Foreign Application Priority Data

Jul. 26, 2005 (JP) ..... 2005-215952

(51) Int. Cl.
*G03G 15/00* (2006.01)
*G03G 15/043* (2006.01)
*G03G 15/06* (2006.01)
*G03G 15/16* (2006.01)

(52) U.S. Cl. ..... 399/12; 399/51; 399/55; 399/66; 399/82

(58) Field of Classification Search ..... 399/12, 399/51, 53, 55, 66, 82; 347/19, 115
See application file for complete search history.

(56) References Cited

U.S. PATENT DOCUMENTS 6,308,018 B1 * 10/2001 Yoshida et al. ..... 399/53
6,996,346 B2 * 2/2006 Ito ..... 399/12

FOREIGN PATENT DOCUMENTS

| | | | |
|---|---|---|---|
| JP | 9-248918 | A | 9/1997 |
| JP | 11-157100 | A | 6/1999 |
| JP | 2001-343883 | A | 12/2001 |
| JP | 2004-294662 | A | 10/2004 |

* cited by examiner

*Primary Examiner*—Sandra L Brase
(74) *Attorney, Agent, or Firm*—Baker Botts, LLP

(57) ABSTRACT

An image forming apparatus includes: a plurality of image carriers on each surface of which an electrostatic latent image is formed, each of the image carriers being attachable and detachable; a plurality of development units each adhering a toner to the electrostatic latent image carried on corresponding one of the image carriers, the development units adhering toners that are different from each other, a plurality of transfer units that transfer the toners adhering to the image carriers to a recording medium; an order detection unit that detects an arrangement order of the loaded image carriers; and an image formation condition setting unit that sets an image formation condition for at least one of the developing unit and each of the image carriers based on the arrangement order detected by the order detection unit.

10 Claims, 5 Drawing Sheets

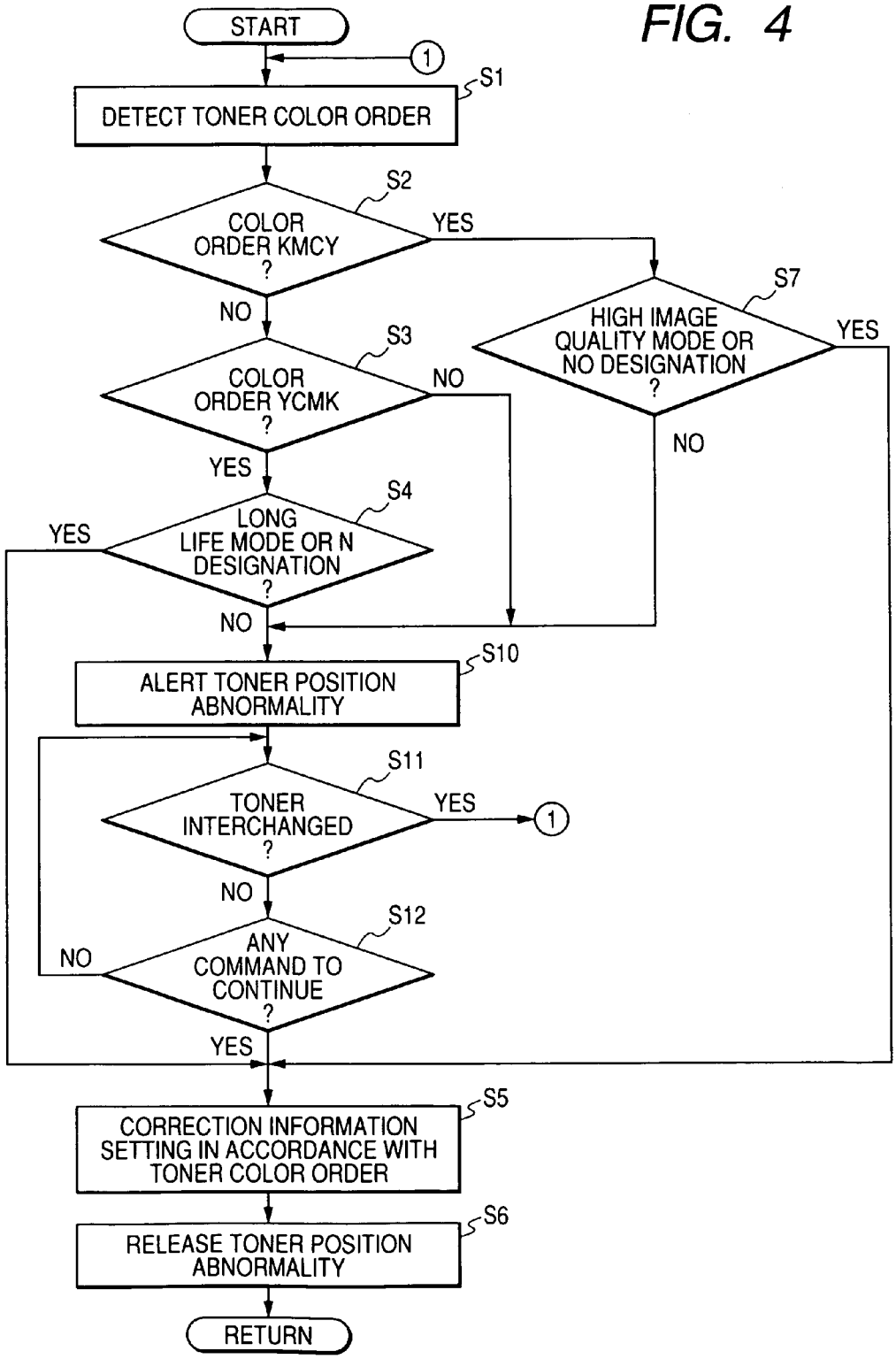
FIG. 4
START
1
S1
DETECT TONER COLOR ORDER
S2
COLOR ORDER KMCY ?
YES
NO
S7
HIGH IMAGE QUALITY MODE OR NO DESIGNATION ?
YES
NO
S3
COLOR ORDER YCMK ?
NO
YES
S4
LONG LIFE MODE OR N DESIGNATION ?
YES
NO
S10
ALERT TONER POSITION ABNORMALITY
S11
TONER INTERCHANGED ?
YES
1
NO
S12
ANY COMMAND TO CONTINUE ?
NO
YES
S5
CORRECTION INFORMATION SETTING IN ACCORDANCE WITH TONER COLOR ORDER
S6
RELEASE TONER POSITION ABNORMALITY
RETURN FIG. 5
| RECORDING ORDER / TONER COLOR | STAGE 1 | STAGE 2 | STAGE 3 | STAGE 4 |
|---|---|---|---|---|
| BLACK | K1 | K2 | K3 | K4 |
| MAGENTA | M1 | M2 | M3 | M4 |
| CYAN | C1 | C2 | C3 | C4 |
| YELLOW | Y1 | Y2 | Y3 | Y4 |
FIG. 6A
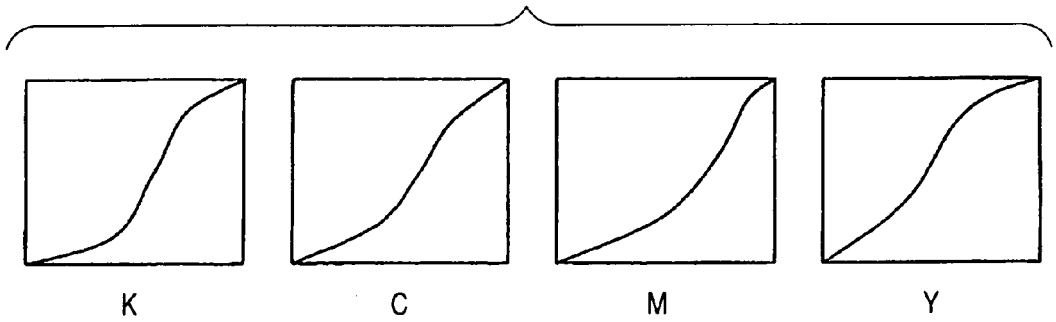
FIG. 6B
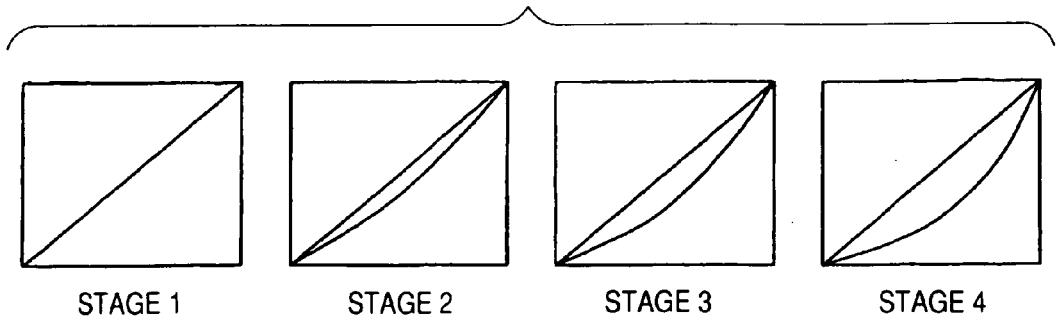

IMAGE FORMING APPARATUS COMPRISING A PLURALITY OF IMAGE CARRIERS

CROSS REFERENCE TO RELATED APPLICATION

This application claims priority from Japanese Patent Application No. 2005-215952, filed on Jul. 26, 2005, the entire subject matter of which is incorporated herein by reference.

TECHNICAL FIELD

Aspects of the present invention relate to an image forming apparatus comprising: a plurality of image carriers on each surface of which an electrostatic latent image is formed and a toner is adhered to the electrostatic latent image by a developing unit; and a transfer unit that transfers the toner adhering to each image carrier to a recording medium. More specifically, aspects of the invention relate to an image forming apparatus in which the toners adhering to the image carriers differ from one another, and each of the image carriers is configured so as to be individually attachable to and removable from a main body of the image forming apparatus.

BACKGROUND

Conventionally, an image forming apparatus comprises: an image carrier on the surface of which an electrostatic latent image is formed and a toner is adhered to the electrostatic latent image by a developing unit; and a transfer unit that transfers the toner adhering to the image carrier to a recording medium. With this kind of image forming apparatus, when the electrostatic latent image is formed on the surface of the image carrier, the toner is adhered to the electrostatic latent image by the developing unit. When the toner adhering to the image carrier is transferred to the recording medium by the transfer unit, a toner image can be formed on the recording medium in accordance with the electrostatic latent image.

Also, there is an image forming apparatus of this kind equipped with four image carriers in a main body of the image forming apparatus. The colors of toners adhered by developing units to the image carriers are yellow, magenta, cyan and black. The four color toners are transferred to be superimposed on a recording medium to form a color image. With this kind of image forming apparatus, each of the image carriers is configured to be individually attachable and removable, and the image carriers are appropriately replaced in accordance with a lifespan.

In the image forming apparatus equipped with the plurality of image carriers, when a user attaches the image carriers in a wrong arrangement order, an effective image formation may become impossible. According to an image forming apparatus disclosed in JP-A-2001-343883, when the arrangement order of the image carriers is wrong, a user is informed of the abnormality.

SUMMARY

However, with such an image forming apparatus, in the event that the arrangement order of the image carriers is wrong, the user needs to reload the image carriers when an abnormality alert is informed. Thus, the operability is poor. Depending on the arrangement order of the image carriers, even though it is different from the order determined in advance, a sufficiently good image formation may be possible by setting appropriate image formation conditions, such as a bias voltage.

Aspects of the invention provide an image forming apparatus equipped with a plurality of image carriers where in a sufficiently good image formation is possible even though the arrangement order of the image carriers is changed.

According to an aspect of the invention, there is provided an image forming apparatus including a plurality of image carriers on each surface of which an electrostatic latent image is formed, each of the image carriers being attachable and detachable; a plurality of development units each adhering a toner to the electrostatic latent image carried on corresponding one of the image carriers, the development units adhering toners that are different from each other, a plurality of transfer units that transfer the toners adhering to the image carriers to a recording medium; an order detection unit that detects an arrangement order of the loaded image carriers; and an image formation condition setting unit that sets an image formation condition for at least one of the developing unit and each of the image carriers based on the arrangement order detected by the order detection unit.

In the above configuration, the order detection unit detects the arrangement order of the plurality of image carriers and, based on the order detected, the image formation condition setting unit sets the image formation condition related to each of the image carriers or the developing unit. Thus, even when a user changes the arrangement order of the image carriers, the image formation condition is set in accordance with that arrangement order, and an efficient image formation is possible.

BRIEF DESCRIPTION OF THE DRAWINGS

FIG. 4 is a flowchart showing a toner order checking process executed by the control system;

FIG. 5 is an explanatory diagram showing a table used in the process; and

FIGS. 6A and 6B are explanatory diagrams showing examples of obtaining correction information by a calculation.

DETAILED DESCRIPTION

Figure 1:
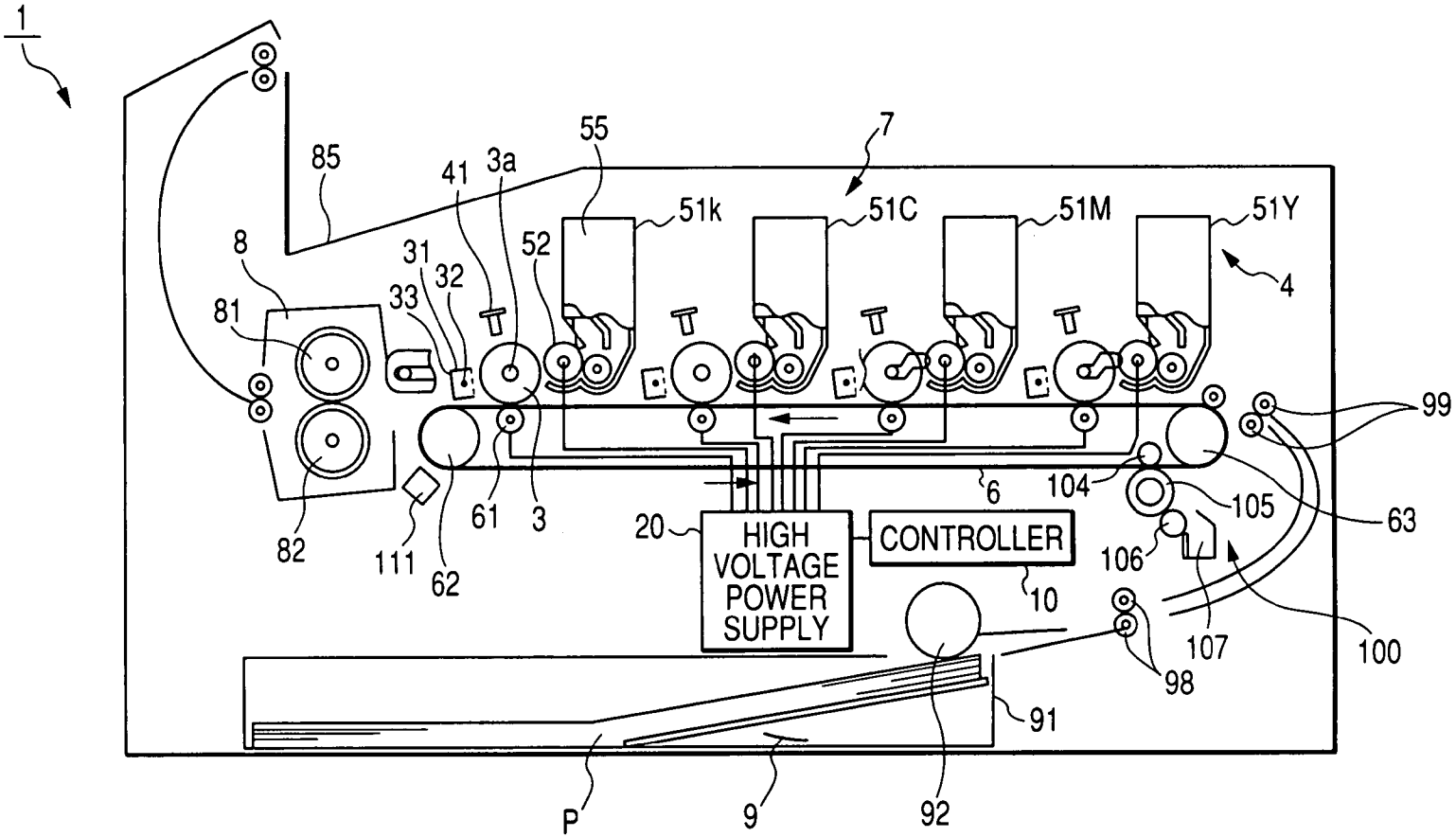
FIG. 1 is a schematic sectional view showing an internal configuration of a printer according to an aspect of the invention.

Now, a description will be given of an aspect of the invention with reference to the drawings. FIG. 1 is a schematic sectional view showing an internal configuration of a color laser printer (hereafter simply called as a printer) 1 as an image forming apparatus. As shown in FIG. 1, the printer 1 in this aspect is a so-called tandem type color laser printer.

[A Configuration of a Color Laser Printer]

The printer illustrated in FIG. 1 comprises: a recording engine 7 as an image formation unit, which comprises a toner image formation section 4 and a sheet conveyor belt 6 as a belt member; a fixing unit 8; a sheet feeding unit 9; a controller 10; and a high voltage power supply 20. The printer 1 forms an image of four colors, in accordance with image data received from an external device, on a sheet P as a recording medium.

The toner image formation section 4 comprises: four developing units 51Y, 51M, 51C and 51K for each of four toner image formation processes according to a yellow, magenta, cyan and black toner stored in the developing units 51Y, 51M, 51C and 51K; photosensitive drums 3 as image carriers provided for the four toner image formation processes; chargers 31 that uniformly charge the photosensitive drums 3; and scanner units 41 that, after charging, expose surfaces of the photosensitive drums 3 with laser beams and form electrostatic latent images in accordance with the image data. A greater part of the scanner unit 41 is omitted from the illustration, and only a portion that emits the laser beam is shown. Also, each developing unit 51 (51Y, 51M, 51C and 51K) and the corresponding photosensitive drum 3 are configured so as to be integrally attachable to and removable from the printer 1. The developing unit 51 may be provided integrally with the photosensitive drum 3. Also, the developing unit 51 may be attachable to and detachable from the photosensitive drum 3.

Hereafter, a detailed description will be given of a configuration of each component. In the following description, when it is necessary to differentiate between colors, a suffix Y (yellow), M (magenta), C (cyan) or K (black) is appended to a reference numeral for each portion. When it is unnecessary to differentiate, the suffix is omitted.

The photosensitive drum 3 of the toner image formation portion 4 is configured of a substantially cylindrical member. The four photosensitive drums 3 are rotatably arranged and aligned in a horizontal direction at almost equally spaced intervals. As the substantially cylindrical member of the photosensitive drum 3, an aluminum substrate on a surface of which a positively chargeable photosensitive layer is formed maybe employed. When loaded in the printer 1, the aluminum substrate is earthed to a ground line of the printer 1.

The charger 31, a so-called Scorotron type charger, comprises: a charging wire 32, which is opposite the photosensitive drum 3 and extended in a width direction of the drum; and a shield case 33, which stores the charging wire 32 and is open on the photosensitive drum 3 side. By applying a high voltage to the charging wire 32, it positively charges (for example +700V) the surface of the photosensitive drum 3. The shield case 33 is equipped with a grid on the open portion of the photosensitive drum 3 side. By applying a predetermined voltage to the grid, the surface of the photosensitive drum 3 is charged to almost the same potential as the grid voltage.

The scanner unit 41 is disposed for each photosensitive drum 3 at downstream of the charger 31 in a rotation direction of the photosensitive drum 3. The scanner unit 41 emits the laser beam from a light source in accordance with one color's worth of image data received from an external device, scans the laser beam by a surface of a polygon mirror rotationally driven by a polygon motor, and projects it onto the surface of the photosensitive drum 3.

When the laser beam corresponding to the image data is projected onto the surface of the photosensitive drum 3 by the scanner unit 41, a surface potential of the projected portion is reduced (+150V to +200V). Thus, an electrostatic latent image is formed on the surface of the photosensitive drum 3.

Each of the developing units 51Y, 51M, 51C and 51K comprises a developing roller 52 in a developing unit case 55 that stores a corresponding color toner. The developing unit is configured such that the developing roller 52 comes into contact with the photosensitive drum 3 at downstream of the scanner unit 41 in the rotation direction of the photosensitive drum 3. Each developing unit 51 positively charges the toner and feeds it onto the photosensitive drum 3 as a uniform thin layer. At a contact portion of the developing roller 52 and the photosensitive drum 3, the developing unit 51 causes the positive electrostatic latent image formed on the photosensitive drum 3 to bear the positively charged toner by a reversal development method, thereby developing the electrostatic latent image.

The developing roller 52 is configured in a cylindrical shape and comprising a substrate such as a conductive silicone rubber. A coating layer of a fluorine-containing resin or a rubber material is formed on a surface of the developing roller 52. The toners stored in the developing unit cases 55 are positively chargeable, non-magnetic one-component toners. The yellow, magenta, cyan and black toner are stored in the developing units 51Y, 51M, 51C and 51K, respectively.

The sheet feeding unit 9 is disposed in a lower portion of the apparatus and comprises: a container tray 91, which contains the sheet P; and a pickup roller 92, which feeds the sheet P. The sheet P contained in the container tray 91 is delivered from the sheet feeding unit 9 one sheet at a time by the pickup roller 92 and fed to the sheet conveyor belt 6 via a conveyor roller 98 and a register roller 99.

The sheet conveyor belt 6 is narrower than a width of the photosensitive drum 3 and has an endless configuration. The belt 6 rotates with the sheet P while holding the sheet P on an upper surface thereof. The belt 6 is stretched between a drive roller 62 and a driven roller 63. Also, transfer rollers (transfer units) 61 are provided in the vicinity of positions where the belt 6 opposes to the photosensitive drums 3 on the opposite side of the sheet conveyor belt 6 to the photosensitive drums 3. The surface of the sheet conveyor belt 6 facing the photosensitive drum 3 is moved by a rotation of the drive roller 62, as shown by arrows in FIG. 1, to a left direction in the drawing and sequentially conveys the sheet P fed from the register roller 99 to the photosensitive drum 3. The belt 6 conveys the sheet P to the fixing unit 8.

A toner removal portion 100, equipped with a cleaning roller 105, is provided in a position near the driven roller 63 on a surface of the sheet conveyor belt 6 turned back by the drive roller 62. The cleaning roller 105 is disposed in such a way as to rotate while making contact with the sheet conveyor belt 6. A predetermined bias is applied between the cleaning roller 105 and a metal electrode roller 104 that is provided on the opposite side of the sheet conveyor belt 6 to the cleaning roller 105. By this bias, toner adhering to the sheet conveyor belt 6 is removed by the cleaning roller 105. For example, by connecting the electrode roller 104 to the ground line to earth it and applying a bias of a polarity opposite to that of the toner (for example, −1200V) to the cleaning roller 105, the toner can be adsorbed onto the cleaning roller 105 and removed. The removed toner is collected in a storage box 107 by a collecting roller 106 and stored in the storage box 107. The cleaning roller 105 is driven by a not-shown drive unit so as to rotate in an opposite direction to the sheet conveyor belt 6 at the contact portion with the sheet conveyor belt 6.

Furthermore, a density detection sensor 111 is provided at a position facing the sheet conveyor belt 6 on the drive roller 62. The density detection sensor 111 comprises: a light source that emits light of an infrared region; a lens that projects the light from the light source onto the sheet conveyor belt 6; and a photo transistor that receives the reflected light. The density detection sensor 111 measures a density of the toner image on the sheet conveyor belt 6.

The transfer roller 61 is configured such that a transfer bias of a polarity opposite to that of the charging polarity of the toner (for example, −10 to −15 μA) is applied between the transfer roller 61 and the photosensitive drum 3 and the toner image formed on the photosensitive drum 3 is transferred to the sheet P conveyed by the sheet conveyor belt 6. Also, for the purpose of developing the electrostatic latent image, a development bias is applied between the developing roller 52 and the photosensitive drum 3.

The fixing unit 8 comprises a heating roller 81 and a pressurizing roller 82. The fixing unit 8 fixes the toner image on the sheet P by heating and pressurizing, while pinching and conveying the sheet P, to which the toner image has been transferred, by the heating roller 81 and the pressurizing roller 82. A stacker 85 is formed on a top surface of the printer 1. The stacker 85, being provided on a sheet discharging side of the fixing unit 8, accommodates the sheet P discharged from the fixing unit 8.

The transfer bias and the development bias are applied respectively to the transfer roller 61 and the developing roller 52 by a high voltage power source 20. The controller 10 comprises a control device using a CPU 11 (refer to FIG. 2) and carries out general control of the printer 1 operations including the control of the high voltage power source 20.

[A configuration of a Control System of the Color Laser Printer]

Figure 2:
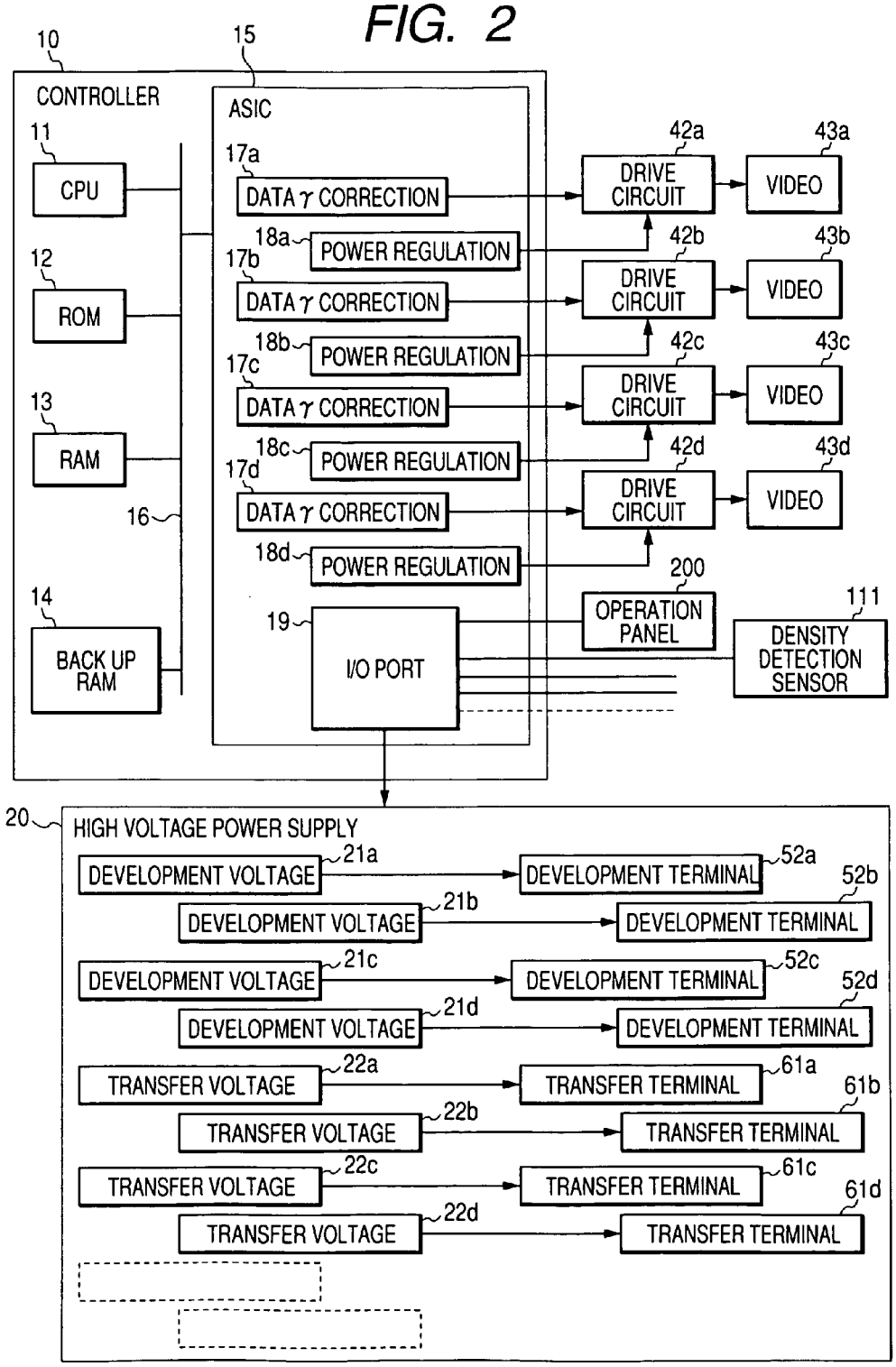
FIG. 2 is a block diagram showing a configuration of a control system of the printer.

FIG. 2 is a block diagram showing a configuration of the controller 10 and the high voltage power source 20. As shown in FIG. 2, the controller 10 comprises: a CPU 11; a ROM 12; a RAM 13; a backup RAM 14; an ASIC (application specific integrated circuit) 15, which are connected by a bus 16. The ASIC 15 is equipped with four data γ correction sections 17*a*, 17*b*, 17*c* and 17*d*, four power regulators 18*a*, 18*b*, 18*c* and 18*d*, and an I/O port 19. The suffixes a, b, c and d correspond to the four scanner units 41 disposed sequentially from the right in FIG. 1 (not necessarily corresponding to the order Y, M, C, K) . The suffixes will be omitted when it is not necessary to differentiate.

Video signals (Video) 43*a*, 43*b*, 43*c* and 43*d*, which drive the laser beam sources of the scanner units 41, 41, 41 and 41, are generated by drive circuits 42*a*, 42*b*, 42*c* and 42*d*, based on signals from the data γ correction sections 17*a*, 17*b*, 17*c* and 17*d*, and signals from the power regulators 18*a*, 18*b*, 18*c* and 18*d*. That is, the drive circuits 42 generate the video signals 43 based on image data γ corrected by the data γ correction sections 17, and a power of the laser beams commanded by the power regulators 18.

The I/O port 19 transmits a plurality of signals including analog signals to the high voltage power source 20 and receives a detection signal from the density detection sensor 111. The I/O port 19 receives a signal in accordance with an operation on an operation panel 200 that is provided on an external surface of the printer 1. Various other signals, such as a drive signal to a buzzer that generates a warning sound, are also received by the I/O port 19, but a description is omitted here.

Figure 3A:
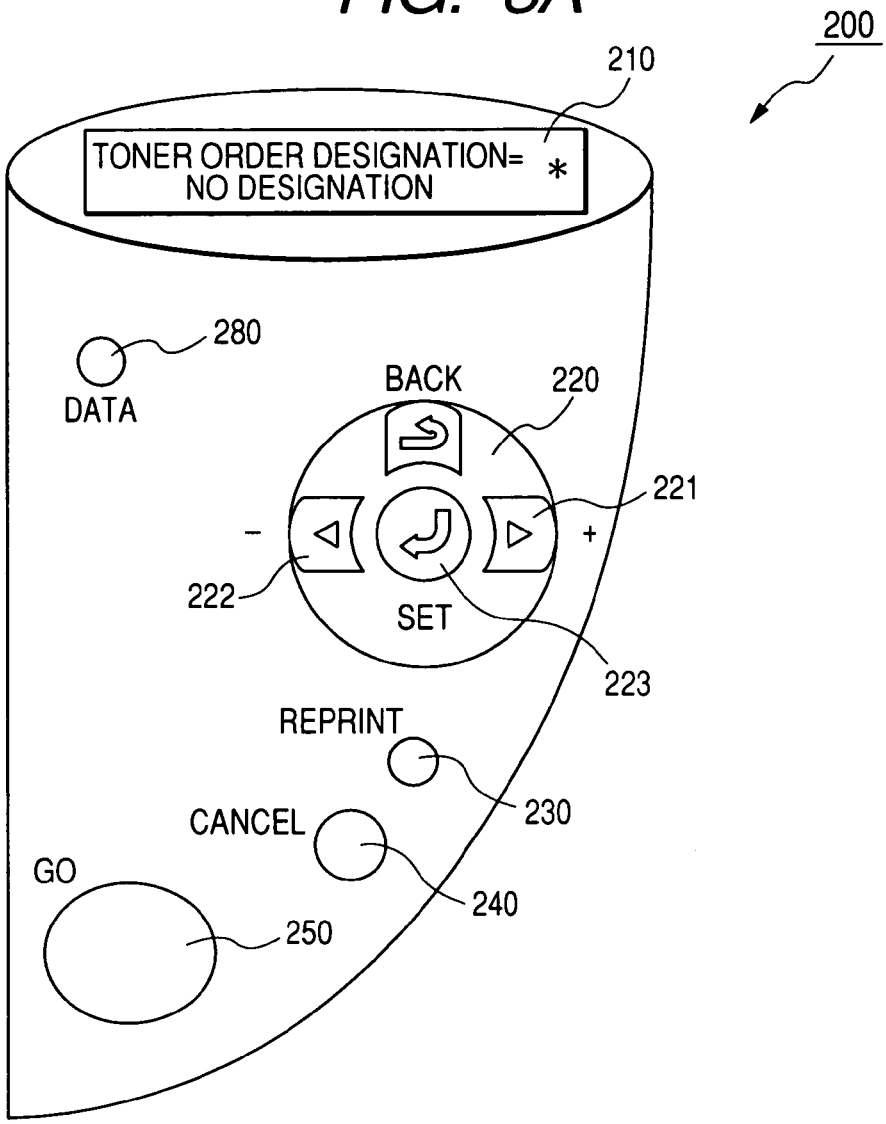
FIGS. 3A to 3C are explanatory diagrams showing a configuration of an operation panel of the printer.

FIG. 3A is an explanatory diagram showing a configuration of the operation panel 200. As shown in FIG. 3A, the operation panel 200 is equipped with an LCD display 210, which shows a setting condition etc. for each type of mode; a menu button 220 for setting the modes; a reprint button 230, which commands a reprinting; a cancel button 240, which commands a cancellation; a go button 250, which commands an execution; and an LED 280, which blinks when data is being received. The menu button 220 is equipped with a + button 221, a – button 222, a set button 223 etc. The menu is of a hierarchical structure, configured in such a way that a menu item displayed on the LCD display 210 by operating the + button 221 or the – button 222 is selected, and the selection is executed by the set button 223.

Figure 3B:
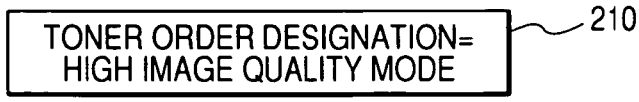
Figure 3C:
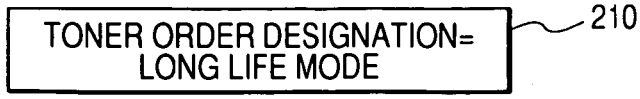

For example, for an item "toner order designation", which specifies the order in which each color of toner is transferred to the sheet P, it is possible to select a desired mode from "no designation" illustrated in FIG. 3A, "high image quality mode" illustrated in FIG. 3B, and "long life mode" illustrated in FIG. 3C. Also, as shown in FIG. 3A, an asterisk is displayed at a right end of a current setting value (in this case "no designation").

As shown in FIG. 2, the high voltage power source 20 is equipped with development voltage appliers 21*a*, 21*b*, 21*c* and 21*d*, which apply the development bias to each of the developing rollers 52, 52, 52 and 52 via development terminals 52*a*, 52*b*, 52*c* and 52*d*, and transfer voltage appliers 22*a*, 22*b*, 22*c* and 22*d*, which apply the transfer bias to each of the transfer rollers 61, 61, 61 and 61 via transfer terminals 61*a*, 61*b*, 61*c* and 61*d*. Other circuits that apply various voltages are also provided in the high voltage power source 20, but a description will be omitted here.

[Controls Executed by the Control System and the Advantageous Effects Thereof]

Now, a description will be given of a process executed by the controller 10. FIG. 4 is a flowchart representing a toner order checking process executed when the power is turned on, and when a cover of the printer 1 is opened and closed for the purpose of replacing the developing unit 51 and the photosensitive drum 3. In the process, it is determined, before the image formation in the printer 1 is started, whether or not an arrangement order (also referred to as a toner color order) of the developing units 51 corresponding to each color and of the photosensitive drums 3 with respect to the conveying direction of the sheet P is correct.

As shown in FIG. 4, when the process is started, first, the toner color order is detected in S1 (S represents a step: the same applies hereafter). In the process, a specified patch pattern is formed on the sheet conveyor belt 6 by the toner image formation section 4, wherein the toner color order is detected by the density detection sensor 111 reading the patch pattern.

In the following S2, it is determined whether or not the toner color order is the order K, M, C, Y. If the order is not K, M, C, Y (S2: N), it is determined in S3 whether or not the toner color order is the order Y, C, M, K. If the toner color order is the order Y, C, M, K (S3: Y), it is determined in S4 whether or not "long life mode" or "no designation" has been set on the operation panel 200.

The "long life mode" is the mode in which the toners are transferred in the order Y, C, M, and K. By transferring the toners in a order from lighter colors, an effect of a staining etc. caused by a reverse transfer of the toner to the photosensitive drum 3 can be minimized, thereby maintaining a long, stable lifespan for the photosensitive drum 3. If the toner color order is Y, C, M, K (S3: Y) , and "long life mode" or "no designation" has been set (S4: Y), the process moves to S5.

In S5, correction information related to the γ correction coefficient, laser beam power, development bias, transfer bias etc. is set, based on the table shown in FIG. 5. That is, as a transfer characteristic and the like of the toner differ according to color, it is necessary to correct the parameters of the γ correction coefficient, laser beam power, development bias, transfer bias etc. in accordance with the color of the toner. The further the positions of the developing units 51 and the photosensitive drums 3 move towards the left in FIG. 1, that is, as they move from stage 1 to stage 2, stage 3 and stage 4, the greater becomes the effect of the transfer bias etc. applied to the sheet Pat the previous stages. Thus, it becomes necessary to further correct the parameters.

In this aspect, the table shown in FIG. 5 is stored in the backup RAM 14, so that it can be known in what way the parameters should be corrected when a certain color reaches a certain stage. In S5, the correction information related to the γ correction coefficient, laser beam power, development bias, transfer bias etc. is set, based on this table. That is, Y1, C2, M3 and K4 in FIG. 5 each represent correction information, the correction information being set in S5.

In the subsequent S6, any toner position abnormality informed thus far is released, and the process ends. Then, the image formation is carried out, in accordance with image data, by a not-shown separate routine, based on the correction information set in S5. It goes without saying that, in the image formation process, the image data corresponding to yellow is input in a first stage scanner unit 41, the image data corresponding to cyan is input in a second stage scanner unit 41, the image data corresponding to magenta is input in a third stage scanner unit 41, and the image data corresponding to black is input in a fourth stage scanner unit 41.

On the other hand, if the toner color order is K, M, C, Y (S2: Y), it is determined in S7 whether or not "high image quality mode" or "no designation" has been set. The "high image quality mode" is the mode in which the toners are transferred in the order K, M, C, and Y. This order is such that lighter colors are transferred later, thereby increasing a color reproducibility. If the toner color order is K, M, C, Y (S2: Y), and "high image quality mode" or "no designation" has been set (S7: Y), the process moves to S5. In this case, K1, M2, C3 and Y4 are set as correction information in S5 and, after the toner position abnormalities are released in the following S6, the process ends.

In a case where the toner color order is neither Y, C, M, K nor K, M, C, Y (S3: N), or in a case where the toner color order is Y, C, M, K even though "high image quality mode" has been set (S4: N), or in a case where the toner color order is K, M, C, Y even though "long life mode" has been set (S7: N), the process moves to S10. In S10, a toner position abnormality is informed of by the alarm sound and the display of the LCD display 210. In the following S11 it is determined whether or not a toner interchange, that is an interchanging of the order of the developing units 51 and the photosensitive drums 3, has taken place. This evaluation is performed based on whether or not the cover of the printer 1 has been opened and closed. At the time when the process first moves to S11, as the toner interchange has not yet taken place (S11: N), the process moves to S12, where it is determined whether or not a command to continue has been given by the operation panel 200. If the command to continue has not been given (S12: N), the process moves to S11. The process waits in the S1, S12 loop process until either the toner interchange or the command to continue occurs.

Then, during the loop process, if the toner interchange takes place (S11: Y), the process is restarted from S1. On the other hand, if the command to continue is given during the loop process (S12: Y), the process moves to 5, the correction information is read from the table in FIG. 5 and set in accordance with the toner color order at that time, then the toner position abnormalities are released (S6), and the process ends. For example, if the toner color order is that shown in FIG. 1, Y1, M2, C3, K4 is set.

In this aspect, by setting the correction information in accordance with the arrangement order of the developing units 51 and the photosensitive drums 3 (S5), the image can be formed effectively. Also, in the event that the order does not correspond to the mode set by the user (S4: N or S7: N), the user can know the fact via the alarm sound and the display of the LCD display 210 (S10) and can correct the order as necessary. In this case, the user can choose to either cancel the image formation and correct the order (S11: Y), or to continue with the image formation without correcting (S12: Y), as he or she desires. Even in the event that the image formation is continued, as the correction information is set in accordance with the order at the time (S5), it is possible to form the image effectively.

In this aspect, the density detection sensor 111 and the S1 process function as an order detection unit, the S5 process as an image formation condition setting unit, the operation panel 200 as a mode setting unit, the S2 to S4 and S7 processes as an arrangement order setting unit, the LCD display 210 and S10 process as an alerting unit, and the S11 and S12 processes as a selection unit.

The invention is not limited to the aspect described heretofore, but can be practiced in a variety of forms without departing from the scope of the invention. For example, in the aspect described heretofore, when the command to continue is given (S12: Y), the correction information is set and the toner position abnormalities are released, whatever the toner color order (S5, S6) . However, for example, it is also acceptable to configure in such a way that the command to continue is rendered invalid in a case of forbidden combinations such as Y coming immediately after K, meaning that a large amount of the K toner mixes with the Y toner causing the Y toner to deteriorate easily, or two or more of the same color existing. Also, in the aspect described heretofore, the toner color order is detected by printing the patch pattern, but it is also acceptable to detect the toner color order by using a proximity switch or an IC tag.

Further, in the aspect described heretofore, four sets of correction information are set for each color of the developing units 51 and for each of the photosensitive drums 3, but it can be considered that there is a case where it is better to further change the correction information according to the color which comes first. Thus, it is also acceptable to set the correction information for each of the 4! possible color arrangements. Furthermore, in the aspect described heretofore, the table in FIG. 5 is stored in the backup RAM 14, but it is also acceptable to provide each of the developing units 51 with an IC tag or the like, in which is stored a table pertaining to its own color, reading with an IC tag reader provided on a main body side of the printer 1.

Also, it is not necessary to store all the correction information in advance as, for example, it is also acceptable to obtain it by calculating as follows. FIG. 6A is an explanatory diagram illustrating a table for each color when disposed in stage 1. In a case where the toner transfer characteristic increases as it goes downstream to stage 2, stage 3 and stage 4 then, as shown in FIG. 6B, by multiplying a correction coefficient that causes a greater reduction the further it goes downstream, it is possible to form the same sixteen items of correction information as in FIG. 5.

The invention can be applied to various kinds of electrophotographic image forming apparatus, such as a copier, a facsimile apparatus and a color laser printer. It is acceptable that an image carrier is a photosensitive belt or an image carrier other than a photosensitive member. Also, the invention can also be applied to an image forming apparatus equipped with a so-called intermediate transfer belt, in which case the intermediate transfer belt also functions as a transfer unit.

Further, as for the image forming apparatus that is used for a purpose that does not particularly require quality of coloring of images, the configuration may be simplified by omitting the setting of the correction information in accordance with the arrangement order of the developing units 51 and the photosensitive drums 3. By doing so, the total cost of the image forming apparatus can be reduced. Even in this configuration, users can set the developing units 51 and the photosensitive drums 3 without being conscious of the arrangement order of the developing units 51 and the photosensitive drums 3 with respect to the paper P. Accordingly, this configuration can also enhance the convenience of the image forming apparatus.

Although not limited thereto, in a case where the electrostatic latent image is formed on the image carriers via an exposure by a laser beam, the image formation condition may be one of a γ correction coefficient related to the formation of the electrostatic latent image, a bias voltage applied between the image carrier and the transfer unit, a bias voltage applied between the image carrier and the developing unit, or a power of the laser beam.

As was described, the image forming apparatus may comprise: a mode setting unit that sets a mode of image formation based on an instruction from a user; an arrangement order setting unit that sets the arrangement order of the image carriers based on the mode set by the mode setting unit; and an alerting unit that informs of an abnormality in a case where the arrangement order detected by the order detection unit and the arrangement order set by the arrangement order setting unit are different.

In this case, the mode setting unit sets the mode of the image formation based on an instruction from the user and, based on the thus set mode, the arrangement order setting unit sets the arrangement order of the image carriers. Then, in the event that the arrangement order detected by the order detecting unit and the arrangement order set by the arrangement order setting unit are different, the alerting unit informs of the abnormality. Thus, in the event that the order does not correspond to the mode set by the user, the user can know the fact via the alerting unit and can correct the arrangement order of the image carriers as necessary. Consequently, in this case, it is possible to more efficiently carry out the image formation that the user intends.

The image forming apparatus may further comprise a selection unit that selects based on an instruction from the user whether to continue the image formation or to cancel the image formation in response to the abnormality informed by the alerting unit. In this case, the user can select, via the selection unit, to either cancel the image formation and correct the arrangement order of the image carriers, or to continue the image formation without correcting.

What is claimed is:

1. An image forming apparatus comprising:

a plurality of image carriers on each surface of which an electrostatic latent image is formed, each of the image carriers being attachable and detachable;

a plurality of development units each adhering a toner to the electrostatic latent image carried on a corresponding one of the image carriers, the development units adhering toners that are different from each other, a plurality of transfer units that transfer the toners adhering to the image carriers to a recording medium;

an order detection unit that detects an arrangement order of the loaded image carriers;

an image formation condition setting unit that sets an image formation condition for at least one of the developing units and each of the image carriers based on the arrangement order detected by the order detection unit;

a mode setting unit that sets a mode of image formation;

an arrangement order setting unit that sets an expected arrangement order of the image carriers based on the mode set by the mode setting unit; and an alerting unit that informs of an abnormality in a case where the arrangement order detected by the order detection unit and the expected arrangement order set by the arrangement order setting unit are different.

2. The image forming apparatus according to claim 1, wherein the electrostatic latent image is formed on each image carrier via an exposure by a laser beam, and the image formation condition is one of a γ correction coefficient related to the formation of the electrostatic latent image, a bias voltage applied between the image carrier and the transfer unit, a bias voltage applied between the image carrier and the developing unit, and a power of the laser beam.

3. The image forming apparatus according to claim 2, further comprising a selection unit that selects whether to continue the image formation or to cancel the image formation in response to the abnormality informed by the alerting unit.

4. The image forming apparatus according to claim 3, wherein the selection unit selects whether to continue based on an instruction from the user.

5. The image forming apparatus according to claim 1, wherein the electrostatic latent image is formed on one of the image carriers by an exposure of a laser beam; and the image formation condition is a shape of the electrostatic latent image.

6. The image forming apparatus according to claim 1, further comprising a selection unit that selects whether to continue the image formation or to cancel the image formation in response to the abnormality informed by the alerting unit.

7. The image forming apparatus according to claim 6, wherein the selection unit selects whether to continue based on an instruction from the user.

8. The image forming apparatus according to claim 1, wherein the mode is set based on an instruction from a user.

9. An image forming apparatus comprising:

a plurality of image carriers on each surface of which an electrostatic latent image is formed, each of the image carriers being attachable and detachable;

a plurality of development units each adhering a toner to the electrostatic latent image carried on a corresponding one of the image carriers, the development units adhering toners that are different from each other, a plurality of transfer units that transfer the toners adhering to the image carriers to a recording medium;

an order detection unit that detects an arrangement order of the loaded image carriers; and an image formation condition setting unit that sets a γ correction coefficient related to the formation of the electrostatic latent image for at least one of the developing units and each of the image carriers based on the arrangement order detected by the order detection unit.

10. An image forming apparatus comprising:

a plurality of image carriers on each surface of which an electrostatic latent image is formed, each of the image carriers being attachable and detachable;

a plurality of development units each adhering a toner to the electrostatic latent image carried on a corresponding one of the image carriers, the development units adhering toners that are different from each other, a plurality of transfer units that transfer the toners adhering to the image carriers to a recording medium;

an order detection unit that detects an arrangement order of the loaded image carriers; and an image formation condition setting unit that sets a bias voltage applied between the image carrier and the transfer carrier unit for at least one of the developing units and each of the image carriers based on the arrangement order detected by the order detection unit.

* * * * *